US006521017B1

(12) United States Patent
Suwa et al.

(10) Patent No.: US 6,521,017 B1
(45) Date of Patent: Feb. 18, 2003

(54) METHOD FOR MELTING METALS

(75) Inventors: Toshio Suwa, Yamanashi (JP); Yoshiteru Kikuchi, Yamanashi (JP); Nobuaki Kobayashi, Yamanashi (JP); Atsushi Inoue, Kanagawa (JP); Hideyuki Honda, Kanagawa (JP)

(73) Assignee: Nippon Sanso Corporation, Tokyo (JP)

( * ) Notice: Subject to any disclaimer, the term of this patent is extended or adjusted under 35 U.S.C. 154(b) by 0 days.

(21) Appl. No.: 09/147,066

(22) PCT Filed: Jan. 30, 1998

(86) PCT No.: PCT/JP98/00386

§ 371 (c)(1),
(2), (4) Date: Sep. 29, 1998

(87) PCT Pub. No.: WO98/35196

PCT Pub. Date: Aug. 13, 1998

(30) Foreign Application Priority Data

Feb. 6, 1997 (JP) ..... 9-024182

(51) Int. Cl.[7] ..... C21C 5/30

(52) U.S. Cl. ..... 75/575

(58) Field of Search ..... 266/900, 901, 266/197; 75/573, 414, 575, 581

(56) References Cited

U.S. PATENT DOCUMENTS

| | | | | | |
|---|---|---|---|---|---|
| 3,759,699 | A | * | 9/1973 | Geiger et al. | 75/574 |
| 4,291,634 | A | * | 9/1981 | Bergsten et al. | 110/235 |
| 4,852,858 | A | * | 8/1989 | Weber | 266/175 |
| 4,877,449 | A | * | 10/1989 | Khinkis | 75/414 |
| 4,881,972 | A | * | 11/1989 | Weber et al. | 75/93 |
| 5,366,536 | A | * | 11/1994 | Suwa et al. | 75/414 |
| 5,395,423 | A | * | 3/1995 | Suwa et al. | 75/380 |
| 5,888,458 | A | * | 3/1999 | Suwa et al. | 266/44 |
| 5,890,443 | A | * | 4/1999 | Taya et al. | 110/346 |

FOREIGN PATENT DOCUMENTS

| | | |
|---|---|---|
| DE | 24 27 360 | 1/1975 |
| EP | 0 031 160 | 7/1981 |
| EP | 0 291 701 | 11/1988 |
| EP | 0 562 635 A1 | 9/1993 |
| EP | 0 563 828 A1 | 10/1993 |
| JP | 54-29316 | 3/1979 |
| JP | 56-501810 | 12/1981 |
| JP | 1-215919 | 8/1989 |
| JP | 2-93012 | 4/1990 |
| JP | 2-182824 | 7/1990 |
| JP | 3-3122 | 1/1991 |
| JP | 4- 59013 | 2/1992 |
| JP | 5-34077 | 2/1993 |
| JP | 5-271804 | 10/1993 |
| JP | 5-271807 | 10/1993 |
| JP | 7-43096 | 5/1995 |
| JP | 8-200968 | 8/1996 |
| JP | 9-105589 | 4/1997 |

* cited by examiner

*Primary Examiner*—Roy King
*Assistant Examiner*—Tima McGuthry-Banks
(74) *Attorney, Agent, or Firm*—Armstrong, Westerman & Hattori, LLP

(57) ABSTRACT

An apparatus for melting a metal provided with a metal melting furnace (10) for melting a metallic raw material with a flame of an oxygen fuel burner (11) to which oxygen is supplied as a combustion assisting gas; and an oxygen supply source for supplying oxygen as a combustion assisting gas to the oxygen fuel burner (11). The metal melting furnace (10) has a preheating section (13) for preheating the metallic raw material above a melting section (12) to which the oxygen fuel burner (11) is attached and a reduced section (14) located between the melting section (12) and the preheating section (13), the reduced section having an inside diameter smaller than those of the melting section and preheating section. The oxygen supply source is a pressure swing adsorption separator (30) employing an adsorbent which adsorbs preferentially atmospheric nitrogen and supplying a low-purity oxygen having an oxygen content of 65 to 94% to the oxygen fuel burner (11).

6 Claims, 7 Drawing Sheets

METHOD FOR MELTING METALS

TECHNICAL FIELD

The present invention relates to an apparatus fort melting metals and a method for melting metals, more specifically to an apparatus for melting scraps, ingots, etc. of iron, copper, aluminum, etc. using an oxygen fuel burner to which oxygen is supplied as a combustion assisting gas.

BACKGROUND ART

There are known metal melting furnaces in which fossil fuels are burned using oxygen fuel burners to which oxygen is supplied as a combustion assisting gas, and scraps or ingots of iron, copper, aluminum, etc. are melted by the heat of combustion. Metal melting furnaces utilizing such oxygen fuel burners are described, for example, in Japanese Unexamined PCT Publication No. 501810/1981 and Japanese Unexamined Patent Publication Nos. 215919/1989, 93012/1990, 271804/1993 and 271807/1993.

These metal melting furnaces generally are each provided with a melting section where a metallic raw material is melted using oxygen fuel burners and a preheating section where the metallic raw material is preheated. In the metal melting furnaces described in Japanese Unexamined PCT Publication No. 501810/1981 and Japanese Unexamined Patent Publication No. 215919/1989, the preheating section is located above the melting section via a closing grid so as to preheat a next charge of metallic raw material. However, in the metal melting furnace having such iron grid above the melting section, the iron grid is exposed to high temperature, so that it must be cooled with water and the like, causing not only a great heat loss but also water leakage, troubles in opening and closing the iron grid, etc. due to severe environment to which the melting furnace is exposed.

Meanwhile, in the metal melting furnace described in Japanese Unexamined Patent Publication No. 271807/1993, which is a so-called reverberatory furnace, a metallic raw material is introduced gravitationally through a slant passage defined in the wall of the furnace into the melting section while it is preheated by the discharge gas from the melting section when the metallic raw material passes through the slant passage. In this case, however, the hot discharge gas tends to flow the upper space of the slant passage serving as the preheating section, so that it is difficult to preheat fully the metallic raw material falling along the lower part of the slant passage, and it is also difficult to control the falling speed of the metallic raw material, because the material is introduced by free fall.

Generally, in a metal melting furnace integrated with the preheating section where the metallic raw material is preheated, the rate of introducing the metallic raw material from the preheating section into the melting section significantly influences the heat efficiency. More specifically, the metallic raw material is preferably introduced at the same rate as it is melted in the melting section. If the raw material introducing rate is too high, a mixture of an unmelted metal portion and a molten metal portion dwells at the bottom of the melting section, and further there may occur a phenomenon that the molten metal solidifies due to heat loss from the bottom of the furnace. On the other hand, if the introducing rate is too low, it takes much time for introducing the metallic raw material to consume extra energy.

Further, metal melting furnaces utilizing oxygen fuel burners can increase heat efficiency to 50% or more. Although they have excellent efficiency as metal melting furnaces, they consume large amounts of oxygen, and the overall energy consumption is great when electric energy necessary for producing oxygen is taken into consideration. For example, when 1 ton of iron is melted, about 120 $Nm^3$ of oxygen is consumed. Thus, an electric power of about 0.45 kW is consumed for producing 1 $Nm^3$ of oxygen in the form of high-purity oxygen (oxygen content: >99%) using an air liquefying and separating unit, so that a total electric power of about 55 kW is necessary for melting one ton of iron.

Therefore, it is an objective of the present invention to provide an apparatus for melting metals which can control the rate of introducing a metallic raw material from the preheating section to the melting section to be within an optimum range and can achieve efficient melting of the metallic raw material with oxygen fuel burners only, and which enables economical supply of oxygen serving as a combustion assisting gas to the oxygen fuel burners and can achieve reduction in the total cost of melting metals, as well as, to provide a method for melting metals.

DISCLOSURE OF THE INVENTION

The apparatus for melting a metal according to the present invention contains a metal melting furnace for melting a metallic raw material with a flame of an oxygen fuel burner to which oxygen is supplied as a combustion assisting gas, and an oxygen supply source for supplying oxygen as the combustion assisting gas to the oxygen fuel burner. The metal melting furnace has a preheating section for preheating the metallic raw material above a melting section to which the oxygen fuel burner is attached and a reduced section, located between the melting section and the preheating section, having an inside diameter smaller than those of the melting section and preheating section. According to a first aspect of the present invention, the oxygen supply source is a pressure swing adsorption separator employing an adsorbent which adsorbs preferentially atmospheric nitrogen and supplying a low-purity oxygen having an oxygen content of 65 to 94% to the oxygen fuel burner. According to a second aspect of the present invention, the oxygen supply source is an air liquefying and separating unit which condenses air to fractionate oxygen and supplies a low-purity oxygen having an oxygen content of 65 to 99% to the oxygen fuel burner. According to a third aspect of the present invention, the oxygen supply source is an oxygen-air mixer which mixes a low-purity or high-purity oxygen with air and supplies a low-purity oxygen having an oxygen content of 65 to 99% to the oxygen fuel burner.

According to the method for melting a metallic material of the present invention, a metallic raw material is melted with a flame of an oxygen fuel burner to which oxygen is supplied as a combustion assisting gas from an oxygen supply source. This method employs a metal melting furnace having a preheating section for preheating the metallic raw material above a melting section to which the oxygen fuel burner is attached and a reduced section, located between the melting section and the preheating section, having an inside diameter smaller than those of the melting section and preheating section and also employs a low-purity oxygen having an oxygen content of 65 to 99% as the combustion assisting gas.

The oxygen fuel burners employable according to this invention are those which form high-temperature flames by burning fossil fuels such as heavy oil, kerosene, pulverized coal, propane gas and natural gases employing low-purity oxygen as a combustion assisting gas. As the oxygen fuel burner, for example, those disclosed in Japanese Patent Publication Nos. 3122/1991 and 43096/1995 may be employed. However, this invention is not to be limited to these burners, but burners of various structures may be employed depending on the kind of fuel and the like.

According to the apparatus and method for melting metals of the present invention, by employing a metal melting furnace in which the preheating section is provided via the reduced section above the melting section, not only the metallic raw material can be preheated efficiently, but also the amount of metallic raw material falling from the preheating section into the melting section can be controlled to an optimum level. Thus, there is no need of incorporating a device for controlling the charge of raw material such as the conventional iron grid, and, for example, scraps or ingots of iron, copper, aluminum, etc. can be melted efficiently in the melting furnace having such simple structure, thus achieving reduction in the production cost and maintenance cost, as well as, improvement of heat efficiency and reduction of melting time.

Besides, the cost required for producing oxygen can be reduced by employing a low-purity oxygen having an oxygen content of 65 to 99% as a combustion assisting gas for the oxygen fuel burners in the metal melting furnace, leading to great reduction in the total metal melting cost.

BEST MODE FOR CARRYING OUT THE INVENTION

The present invention will be described more specifically referring to the attached drawings.

Figure 1:
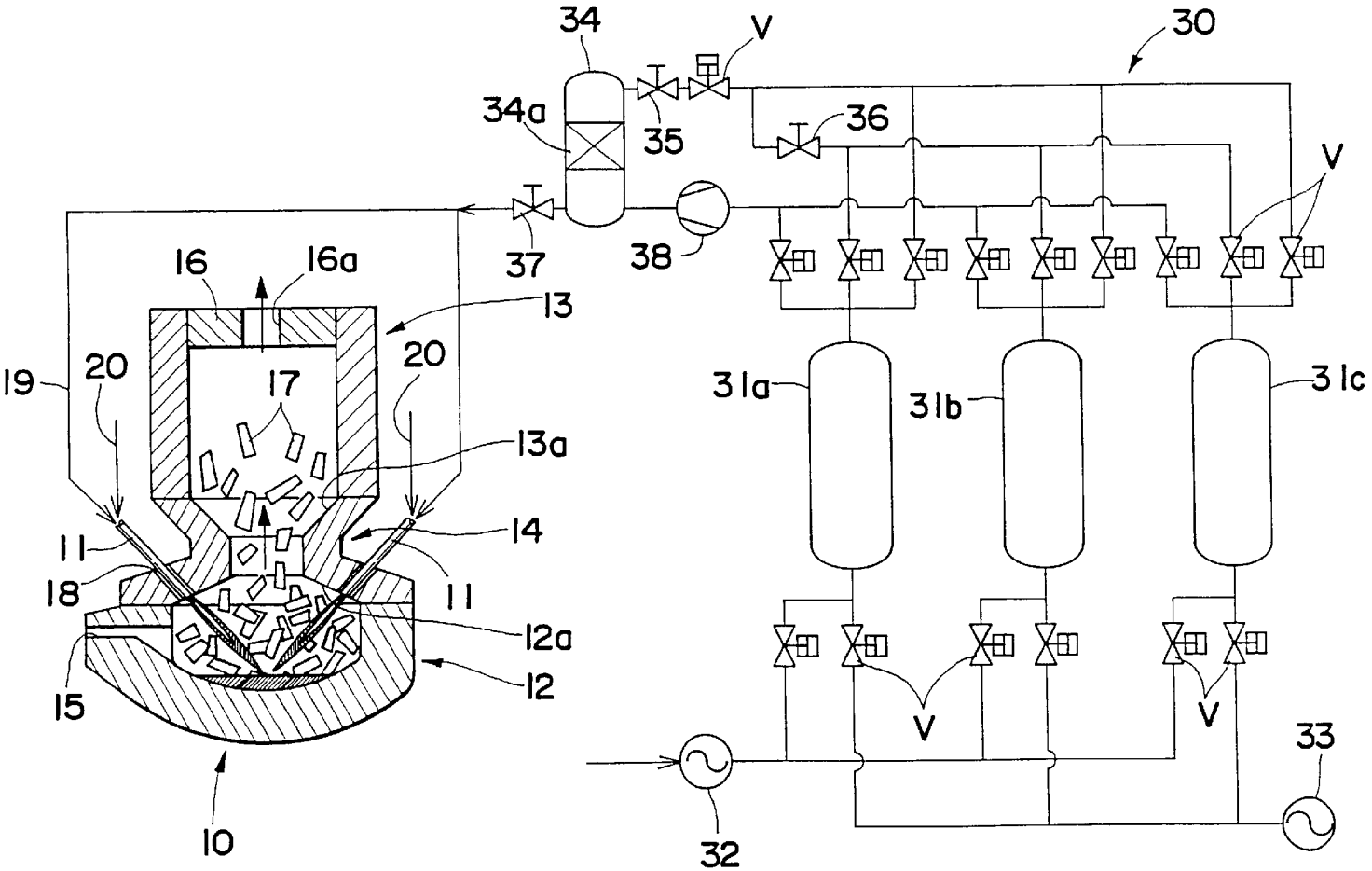
FIG. 1 is a system diagram showing an apparatus for melting metals according to a first embodiment of the present invention.

FIG. 1 is a system diagram showing an apparatus for melting metals according to a first embodiment of the present invention.

This apparatus for melting metals employs a metal melting furnace 10 for melting and regenerating metals, for example, scraps or ingots of iron, copper, aluminum, etc. resorting only to the heat of combustion generated by oxygen fuel burners 11 employing oxygen as a combustion assisting gas. The metal melting furnace 10 has a melting section 12 at the bottom and a preheating section 13 at the top, formed integrally with the melting section 12, with a reduced section 14 being located between the melting section 12 and the preheating section 13.

The melting section 12 has an interior profile substantially the same as that of an ordinary metal melting furnace, e.g., an electric furnace, and is made of a magnesia-carbon type refractory material containing 5 to 20% by weight of carbon. Further, the melting section 12 has on one side a tapping port 15 for tapping a molten metal formed by the melting treatment.

The preheating section 13 is formed into a substantially cylindrical shape and is made of an alumina-silica type refractory material. Further, a lid 16 having a vent 16*a* is removably applied to the upper opening of the preheating section 13.

The reduced section 14 is defined for controlling the falling speed of a metallic raw material 17 falling from the preheating section 13 to the melting section 12 and has an inside diameter smaller than those of the melting section 12 and preheating section 13. The reduced section 14 is made of a magnesia-chromia type refractory material containing 10 to 30% by weight of chromia. This reduced section 14 is preferably connected to the large-diameter melting section 12 and to the preheating section 13 by slant faces 12*a*, 13*a* having conical shapes, respectively, as shown in FIG. 1. Although it is possible to connect these sections with curved faces, in the case of a furnace with a lining of refractory material, such curved surfaces make the procedures of lining the refractory material intricate. If the angles of these slant faces 12*a*, 13*a* are close to perpendicular, the furnace becomes high; whereas if they are close to horizontal, dead spaces are formed to be likely to lower heat efficiency etc. Accordingly, the slant face 12*a* of the ceiling of the melting section 12 and the slant face 13*a* at the lower part of the preheating section 13 are preferably designed to have an angle of about 20 to 60 degrees and an angle of about 20 to 70 degrees with respect to the horizontal, respectively.

While the reduced section 14 can be designed to have a suitable size depending on the treating capacity of the furnace, the capacity of oxygen fuel burners, the kind of metallic raw material, the sizes of the melting section 12 and the preheating section, etc., it is usually desirable to design the preheating section 13 to have a cross-sectional area of 1.4 to 5 times, preferably 1.5 to 4 times, as large as that of the reduced section 14. Meanwhile, since the relationship between the substantial volume of the preheating section 13 and that of the melting section 12 also influences the melting capacity of the furnace, it is desirable to design the preheating section 13 to have a substantial capacity of 0.4 to 3 times, preferably 0.5 to 2 times, as large as that of the melting section 12.

One or more oxygen fuel burners 11 are to b e inserted to burner insertion holes 18 defined through the barrel of the melting section 12 depending on the melting capacity to be required, and the burners 11 can b e suitably positioned at the vertical portion of the furnace wall or the ceiling depending on the size of the melting section 12 etc. The oxygen fuel burners 11 are oriented such that flames may be injected therefrom toward the bottom of the melting section 12, so that the metallic raw material 17 fallen into the melting section 12 may be melted from the lower portion in contact with the bottom of the melting section 12.

To the burner 11 are supplied a low-purity oxygen serving as a combustion assisting gas from an oxygen supplying source disposed near the metal melting furnace 10 through a line 19 and also a fuel such as a heavy oil or a pulverized carbon through a line 20. The combustion assisting gas and the fuel are supplied usually under supply pressures of 3 to 10 kg/cm$^2$.

The oxygen supplying source shown in this embodiment is a pressure swing adsorption separator utilizing an adsorbent which adsorbs preferentially atmospheric nitrogen, in which nitrogen contained in air employed as a source is adsorbed and separated to generate a low-purity oxygen as a product.

This pressure swing adsorption separator (PSA unit) 30 is of a triple-column system having three adsorption columns 31*a*, 31*b*, 31*c* packed with an adsorbent which adsorbs preferentially atmospheric nitrogen, such as zeolite, and is provided with a blower 32 for increasing to the predetermined pressure of the source air and supplying the compressed air to the adsorption columns, a vacuum pump 33 for evacuating the adsorption columns, a product storage tank 34 for storing therein temporarily the product oxygen led out of the adsorption columns, flow control valves 35, 36 for controlling gas flow rate in regenerating step or pressurizing step, a flow control valve 37 for controlling the feed amount of product oxygen gas and a multiplicity of automatic valves V for carrying out switching of each column to adsorption step, regenerating step, etc.

The PSA unit 30 is designed to generate an oxygen gas continuously by opening and closing the multiplicity of automatic valves V in a predetermined order, and an oxygen gas is generated continuously by carrying out switching of each column to the adsorption step and the regenerating step successively. For example, when the adsorption column 31*a* is in the adsorption step, separation of atmospheric oxygen and atmospheric nitrogen is carried out therein, and atmospheric nitrogen is preferentially adsorbed by the adsorbent in the column, while oxygen is fed from the adsorption column 31*a* to the product storage tank 34. Meanwhile, the other adsorption columns 31*b*, 31*c* are in the regenerating step including pressure equalization, evacuation by the vacuum pump 33, purging, pressurization, etc. After a predetermined time, the adsorption column having completed the regenerating step is adapted to be switched to the adsorption step, whereas the adsorption column 31*a* having been in the adsorption step is to be switched to the regenerating step.

Further, while the product storage tank 34 is provided so as to stabilize the pressure and flow rate of the oxygen to be supplied through the flow control valve 37 and the line 19 to the oxygen fuel burners 11, the oxygen content of the oxygen to be supplied from the tank 34 can also be stabilized by packing an adsorbent 34*a* such as zeolite and the like therein. Incidentally, it is also possible to install on the upstream side of the product storage tank 34 an oxygen compressor 38 for compressing, as necessary, the product oxygen.

In such PSA unit 30, it is difficult to achieve separation of atmospheric argon from atmospheric oxygen, and the product oxygen contains argon as a contaminant, so that the resulting product oxygen has a maximum oxygen content (oxygen purity) of about 96% (the rest is mostly argon).

Generally, argon does not substantially affect the quality of metals such as steel, but nitrogen remains as a contaminant in metals since it dissolves in metals or precipitates when the metals are solidified, causing occasionally deterioration of metallic materials such as steel. Accordingly, a gas having a highest possible oxygen content has conventionally been employed as a combustion assisting gas. However, since most of products formed employing molten scraps have low nitrogen sensitivity, and since the combustion assisting gas is diluted with the fuel combustion exhaust gas, inclusion of nitrogen in the combustion assisting gas presents no problem in many cases.

It should be noted here that in the oxygen fuel burners 11, there is a correlation between the oxygen content of the combustion assisting gas employed and the flame temperature, and the oxygen fuel burner themselves can form flames having a high temperature of 2,500° C. or higher by employing a combustion assisting gas having an oxygen content of 40% or more. Thus, when a metal is to be melted, it is possible to obtain a sufficient flame temperature for melting the metal and a metal product having no problem in its quality by employing a combustion assisting gas having an oxygen content of 40% or more and containing nitrogen in such an amount that it may give no influence. However, since a large amount of nitrogen if present as a contaminant which does not contribute to combustion at all causes energy loss for heating it, leading to reduction in heat efficiency.

Figure 2:
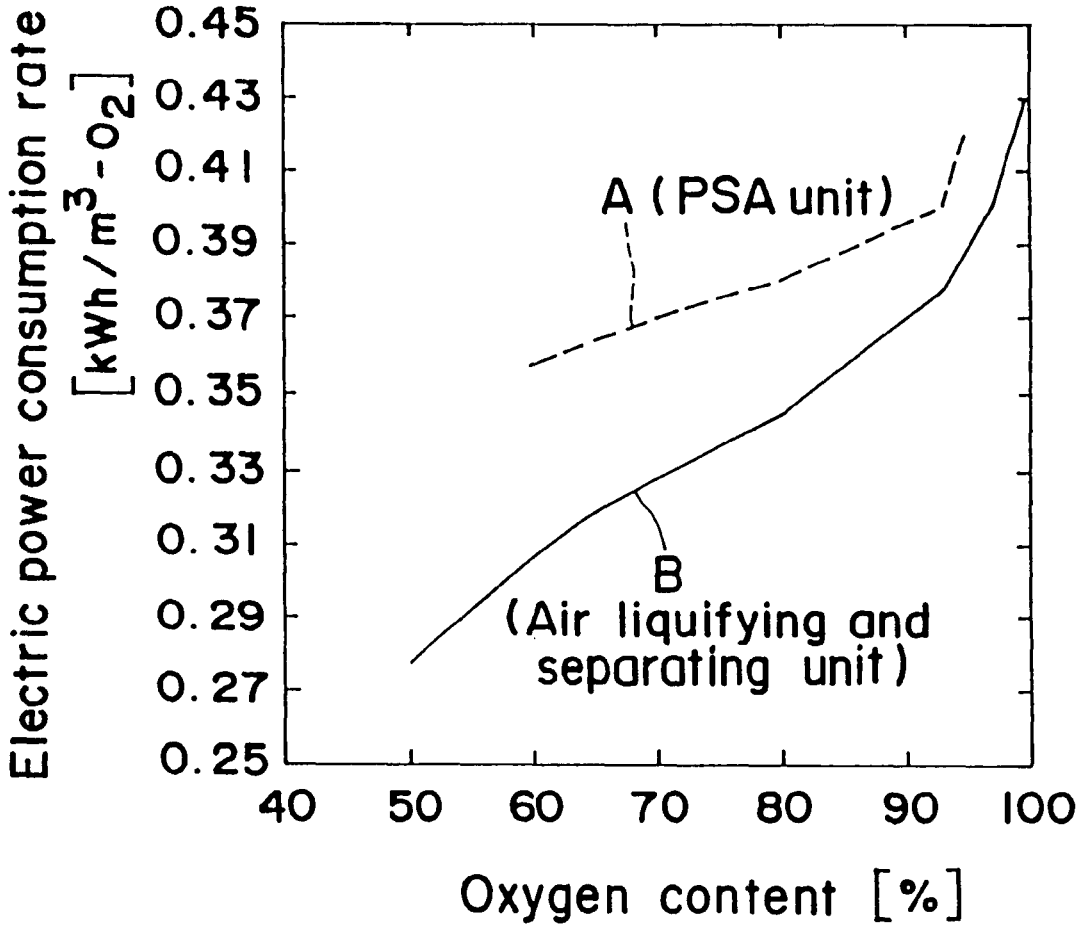
FIG. 2 is a graph of oxygen contents of oxygen products vs. electric power consumption rates.

Meanwhile, the electric power consumption rate of the product oxygen in the PSA unit 30 tends to decrease as the oxygen content of the oxygen collected as a product is lowered as indicated by the broken line A in FIG. 2 and increases abruptly when the oxygen content is increased to 95% or more.

For such reasons, when a metallic raw material is to be melted with the oxygen fuel burners 11 employing the metal melting furnace 10 having the structure as described above, there is an optimum range of oxygen content for the combustion assisting gas so as to save consumption energy. More specifically, if a combustion assisting gas having a high-purity oxygen content is employed, the metal melting furnace 10 can exhibit a high metal melting efficiency. However, the total cost required for melting the metal is relatively high, because the cost of producing the combustion assisting gas i s increased. On the other hand, if a combustion assisting gas having a low-purity oxygen is employed, the cost required for producing the combustion assisting gas may be reduced. However, the metal melting furnace 10 exhibits a low efficiency to require a long time for melting the metallic raw material and consume large amounts of combustion assisting gas and fuel, resulting in the failure of reducing the metal melting cost.

As a result of discussion made by the present inventors, when a combustion assisting gas produced by the PSA unit 30 is employed, a low-purity oxygen having an oxygen content of 65 to 94%, preferably 68 to 90%, particularly preferably 75 to 85% is supplied as the combustion assisting gas to the oxygen fuel burners 11, and thus the oxygen production cost can be reduced without affecting the melting efficiency in the metal melting furnace 10, enabling reduction in the total metal melting cost.

Figure 3:
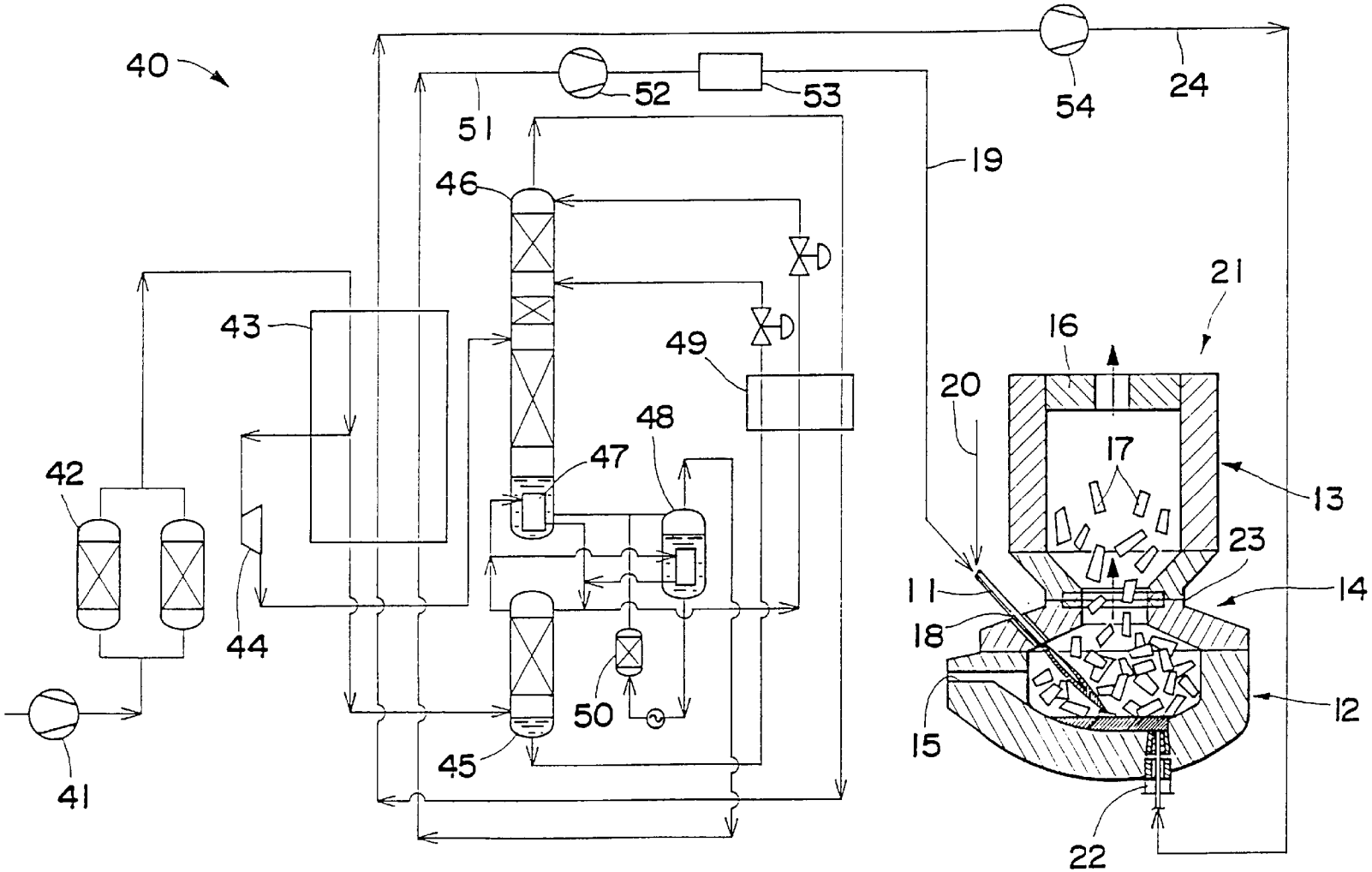
FIG. 3 is a system diagram showing an apparatus for melting metals according to a second embodiment of the present invention.

FIG. 3 shows a second embodiment of the present invention, in which an air liquefying and separating unit 40 is employed as an oxygen supplying source for supplying oxygen to an oxygen fuel burner 11. A metal melting furnace 21 employed in the-second embodiment has a molten metal agitating nozzle 22, for blowing a gas into the molten metal and agitating the molten metal, at the bottom of the melting section 12, and a splitting section 23 for splitting the melting section 12 from the preheating section 13 provided at the middle of the reduced section 14. Since the other parts are substantially of the same structures as in the metal melting furnace 10 of the first embodiment, the same and equivalent parts are affixed with the same reference numbers respectively, and detailed description of them will be omitted.

The air liquefying and separating unit 40 employed as the oxygen supplying source in the second embodiment consists of a source air compressor 41, an adsorber 42, a main heat exchanger 43, an expansion turbine 44, a high-pressure column (lower column) 45, a low-pressure column (a higher column) 46, a main condenser-evaporator 47, a sub-condenser 48, a supercooler 49, a hydrocarbon adsorber 50, etc., in which an oxygen gas formed by evaporation in the sub-condenser 48 is designed to be supplied to the oxygen fuel burner 11 of the metal melting furnace 21.

The source air compressed in the source air compressor 41 is purified through the adsorber 42 and cooled in the main heat exchanger 43. The thus treated source air is partly introduced through the expansion turbine 44 to the low-pressure column 46, and the rest of it is introduced to the high-pressure column 45 where it is subjected to liquefaction and fractionation to be separated into a nitrogen gas collecting at the head of the low-pressure column 46 and a liquefied oxygen collecting at the bottom of the column 46. The liquefied oxygen is heated in the sub-condenser 48 by the nitrogen gas fed from the high-pressure column 45 to be converted by evaporation into an oxygen gas, which is then heated to the normal temperature in the main heat exchanger 43 and led out to a line 51. The oxygen gas introduced to the line 51 is compressed to a predetermined pressure by an oxygen compressor 52, and passes through a controller 53 and the like for controlling the flow rate and pressure of the gas. The gas adjusted to have the pressure, flow rate and oxygen content through the controller 53 etc. is supplied to the oxygen fuel burner 11.

The air liquefying and separating unit 40 having such structure can produce an oxygen gas having a high purity of almost 100% by setting the fractionating conditions and is operated in conventional oxygen producing plants under conditions for producing a high-purity oxygen having an $O_2$ content of 99.5%. In this unit 40, there is correlation between the oxygen content of the oxygen gas collected and the electric power consumption rate like in the PSA unit as indicated by the solid line B in FIG. 2, and the electric power consumption rate tends to increase as the oxygen content increases. Accordingly, if the air liquefying and separating unit 40 is employed as the oxygen supplying source for the oxygen fuel burner 11, the cost required for melting metals can be reduced by setting an optimum oxygen content like in the PSA unit 30.

Further, since the oxygen gas to be collected is obtained by evaporation in the sub-condenser 48 as described in this embodiment, the operation pressure of the high-pressure column 45 can be reduced to reduce power consumption in the source air compressor 41, giving a low-purity oxygen having an oxygen content of about 90% at a lower cost.

Meanwhile, the molten metal agitating nozzle 22 is adapted to heat a molten metal uniformly by blowing a gas into it to agitate it. An inert gas such as argon is employed as the gas to be blown into the molten metal from the nozzle 22. In this embodiment, the nitrogen gas separated and collected at the head of the low-pressure column 46 of the air liquefying and separating unit is compressed to a predetermined pressure by a nitrogen compressor 54, and the compressed nitrogen gas is supplied through a line 24 to the molten metal agitating nozzle 22. If an air liquefying and separating unit 40 having an argon separating function is employed, argon can be also employed as the agitating gas.

Figure 4:
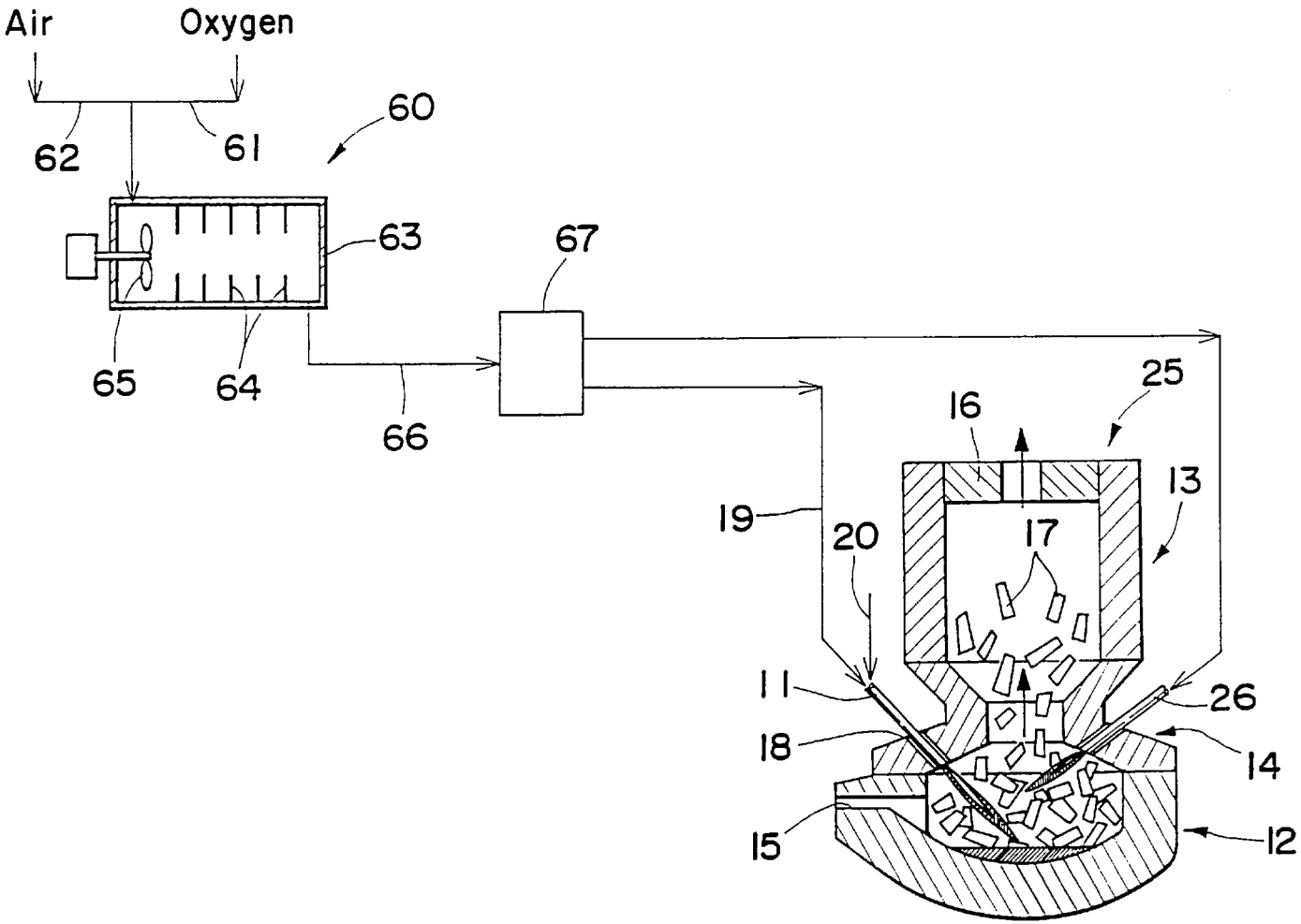
FIG. 4 is a system diagram showing an apparatus for melting metals according to a third embodiment of the present invention.

FIG. 4 shows a third embodiment of the present invention, in which an oxygen-air mixer 60 is employed as an oxygen supply source for supplying oxygen to an oxygen fuel burner 11. A metal melting furnace 25 in this embodiment has a secondary combustion oxygen nozzle 26 at the upper part of the melting section 12, and the other parts are substantially the same as in the metal melting furnace 10 of the first embodiment. The same and equivalent parts are affixed with the same reference numbers respectively, and detailed description of them will be omitted.

In the oxygen-air mixer 60 employed as the oxygen supply source, the oxygen supplied through a line 61 and air supplied through a line 62 are mixed in a mixing container 63 to provide an oxygen gas having a desired oxygen content. The mixing container 63 may, as necessary, contain fins 64 or agitating fan 65 for promoting mixing of these two components. The oxygen gas having a predetermined oxygen content obtained in this oxygen-air mixer is supplied through a line 66, a buffer tank 67, and flow rate controllers and pressure controllers which are disposed at appropriate positions to the oxygen fuel burner 11 and the secondary combustion oxygen nozzle 26.

The oxygen gas to be supplied through the line 61 need not be of high purity and may be a low-purity oxygen having an oxygen content of about 90% or less. However, if the oxygen supplied to the oxygen fuel burner 11 has an oxygen content of less than 65%, efficiency in the metal melting furnace 25 becomes poor, so that the oxygen gas to be supplied to the burner 11 formed by mixing with air desirably has an oxygen content of 65% or more, preferably 68% or more, particularly preferably 75% or more.

Further, in FIG. 4, while oxygen having the same oxygen content is fed to the oxygen fuel burner 11 and to the secondary combustion oxygen nozzle 26, an oxygen gas having a relatively high oxygen content which is not mixed with air yet may be supplied to the secondary combustion oxygen nozzle 26.

It should be noted here that the secondary combustion oxygen nozzle 26 is designed to blow oxygen into the melting section 12 so as to burn combustible components occurring from the metallic raw material, auxiliary materials, etc. during melting of the metallic raw material and improve heat efficiency and can be disposed at a suitable position of the furnace wall depending on the size and the like of the melting section 12.

As described in the above embodiments, while various types of equipments can be employed selectively as sources for supplying low-purity oxygen gases to oxygen fuel burners 11, the PSA unit enjoys advantages that the facility cost is relatively low and that the unit can be started and stopped relatively easily conforming to the operational conditions of the metal melting furnace compared with the air liquefying and separating unit. Further, since the air liquefying and separating unit can produce a large amount of oxygen easily and at a low cost, it can be suitably employed in a large-scale metal melting facility. If high-purity oxygen, high-purity nitrogen and the like are employed in other facilities, the air liquefying and separating unit can be also utilized for such facilities. Meanwhile, while the oxygen-air mixer has a low effect of reducing the oxygen production cost, it is suitably employed in the cases where there is no space for installing the PSA unit or air liquefying and separating unit near the metal melting facility and oxygen supplied in the form of liquid oxygen (generally of high-purity oxygen) must be employed as such or in the cases where a high-purity oxygen producing unit is installed in relation with other facilities. Further, a chemical adsorption air separator utilizing a metallic salt solution can also be employed as the oxygen supply source.

It should be noted here that the combination of the metal melting furnace and the oxygen supply source is not to be limited to the above embodiments, and any arbitrary combination can be employed, and that minute structures and constitutions of the metal melting furnace and the oxygen supply source and operation method of the oxygen supply source can be suitably selected depending on the kind and amount of metal to be melted, as well as, on the oxygen content, amount, etc. of the gas to be supplied to oxygen fuel burners.

EXAMPLE 1

Using a metal melting furnace of the structure shown in FIG. 1, 1 ton of iron scrap (heavy scrap) was melted while the oxygen content of the combustion assisting gas to be supplied to the oxygen fuel burner was changed so as to measure melting time, amount of the combustion assisting gas, yield and heat efficiency relative to the oxygen content of the combustion assisting gas. The molten metal was tapped at a constant temperature of 1630° C.

The melting section of the metal melting furnace employed had a total height of 80 cm, an inside diameter of 90 cm, and a ceiling angle of about 30°, and the reduced section had an inner wall surface height of about 20 cm. The ratio of the substantial capacity of the preheating section to that of the melting section was about 1:1, and the horizontal cross-sectional area of the preheating section was 1.5 times as large as that of the reduced section. If 1 ton of iron scrap is charged into this metal melting furnace, the iron scrap will be present in the preheating section and the melting section in an amount of about 500 kg each, and the height of the bath surface when all of the iron scrap is melted will be about 22 cm.

Three oxygen fuel burners were attached to the slant ceiling of the melting section at an angle of about 60 degrees with respect to the horizontal plane toward the center of the furnace bottom. These burners are positioned such that the capacity of the portion of the melting section lower than nozzle holes of the oxygen fuel burners to the entire capacity of the melting section may be 0.45:1 and that flames may be injected toward the periphery of a circle having a diameter of 63 cm drawn on the furnace bottom around the center of gravity of the melting section. To these three oxygen fuel burners were supplied a pulverized coal (volatiles content: 35%; heat value: 6900 kcal/kg) as a fuel at a rate of 110 kg/hour in total and a combustion assisting gas heated to about 600° C. in such an amount that the ratio of oxygen to the fuel may be 1.0 irrespective of the oxygen content. The flames of these oxygen fuel burners showed a maximum temperature of about 2,800° C.

Figure 5:
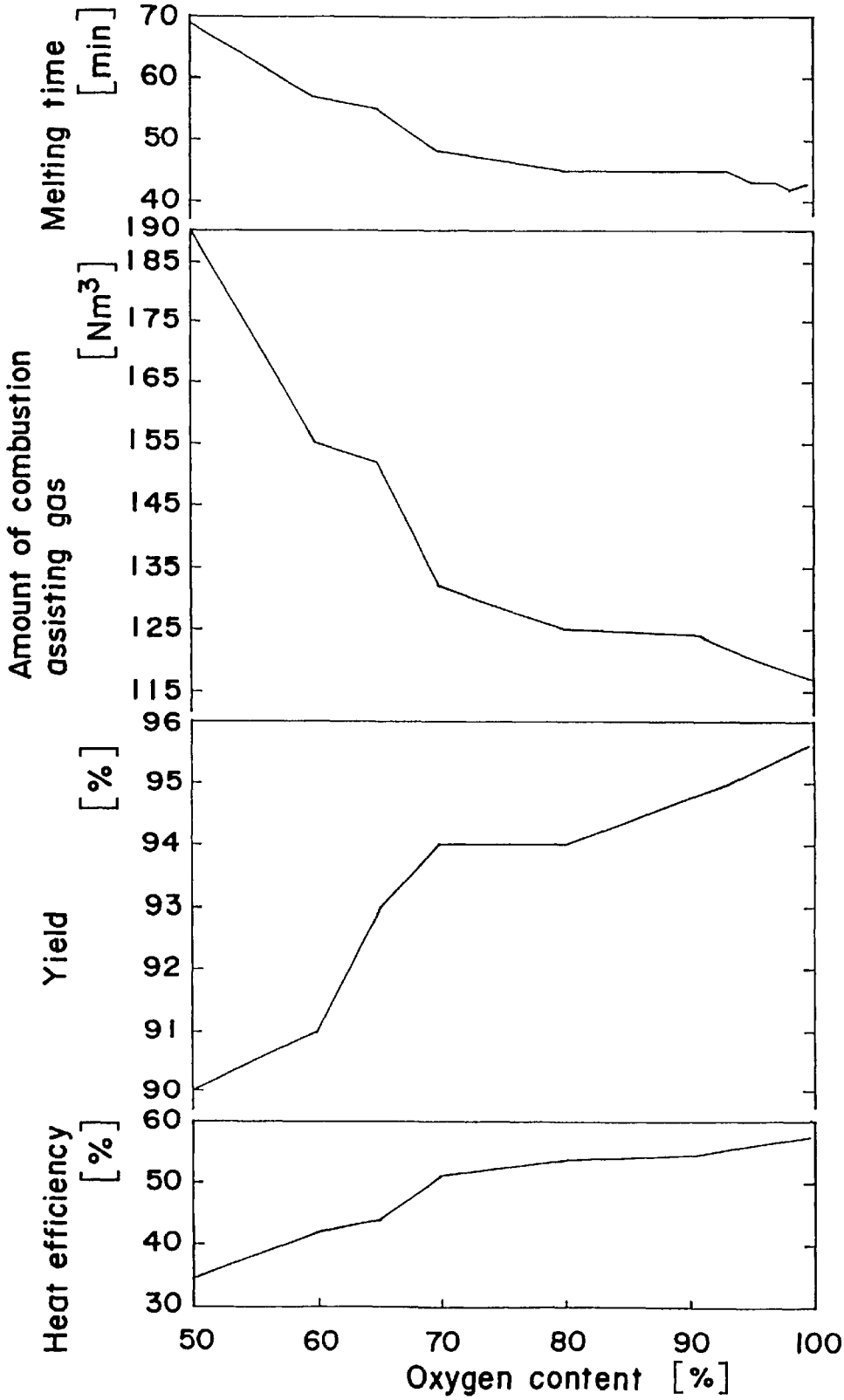
FIG. 5 is a graph of melting time, amount of combustion assisting gas, yield and heat efficiency vs. oxygen content of a combustion assisting gas.

The results are as shown in FIG. 5. Incidentally, heat efficiency was determined according to the following expression:

$$\eta = HY/Q$$

wherein $\eta$ represents heat efficiency; H represents heat capacity per 1 ton of molten metal; Y represents yield of molten metal; and Q represents heat of combustion required for melting 1 ton of metallic raw material.

EXAMPLE 2

A test was carried out in the same manner as in Example 1 employing the same metal melting furnace as used in Example 1, except that the oxygen fuel burners were replaced with those to which a heavy oil is supplied. The heavy oil was supplied to the three oxygen fuel burners at a flow rate of 90 lit/hour in total, and the combustion assisting gas was supplied in such an amount that the total flow rate of the oxygen content in the gas to be supplied to the three burners may be 180 $Nm^3/h$.

Figure 6:
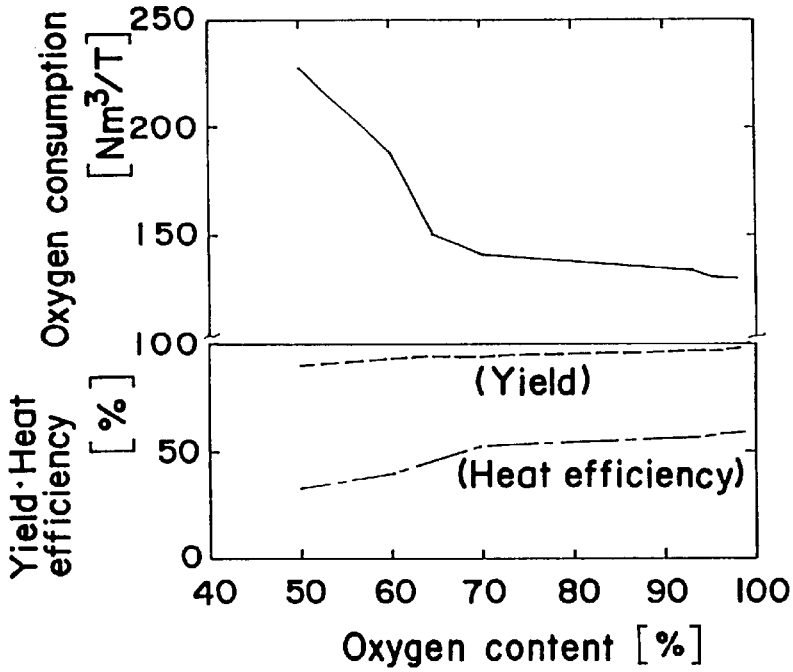
FIG. 6 is a graph of heat efficiency, yield and oxygen consumption vs. oxygen content of a combustion assisting gas.
Figure 7:
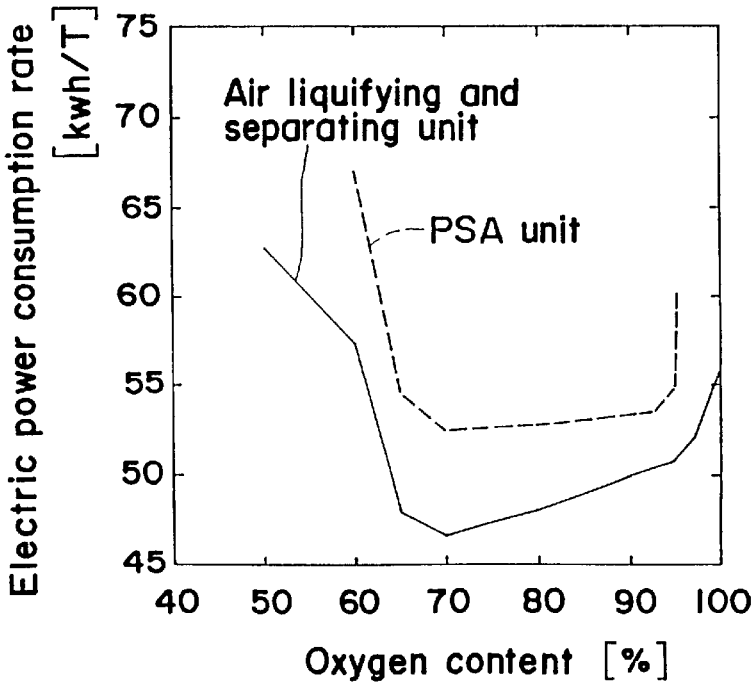
FIG. 7 is a graph of oxygen content of a combustion assisting gas vs. electric power consumption rate required for melting 1 ton of iron.
Figure 8:
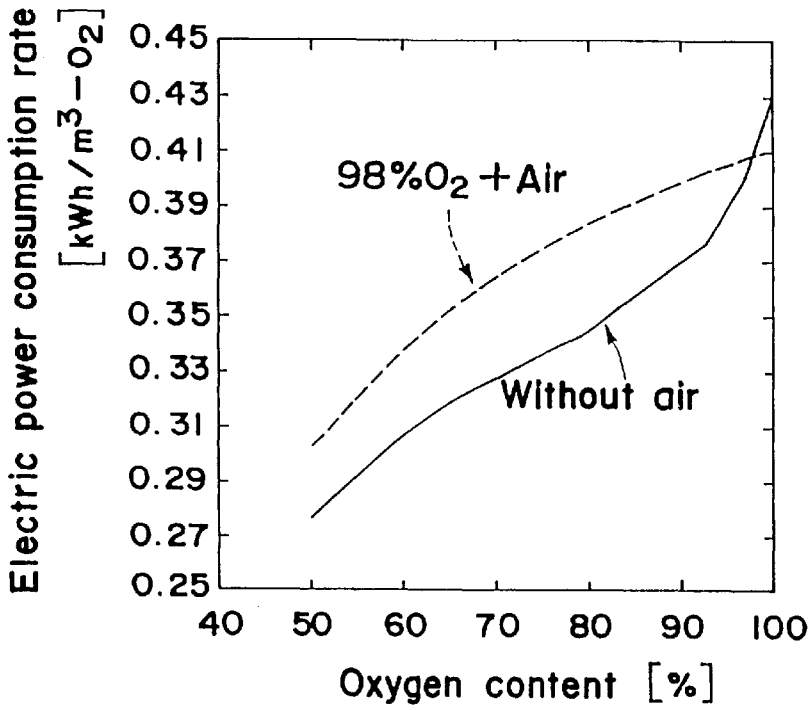
FIG. 8 is a graph comparing electric power consumption rates when combustion assisting gases of various contents prepared by producing an oxygen gas having an oxygen content of 98% using an air liquefying and separating unit and admixing air thereto in an oxygen-air mixer were used and those when oxygen gases of various oxygen contents were prepared (without admixing of air) employing the air liquefying and separating unit were used.
Figure 9:
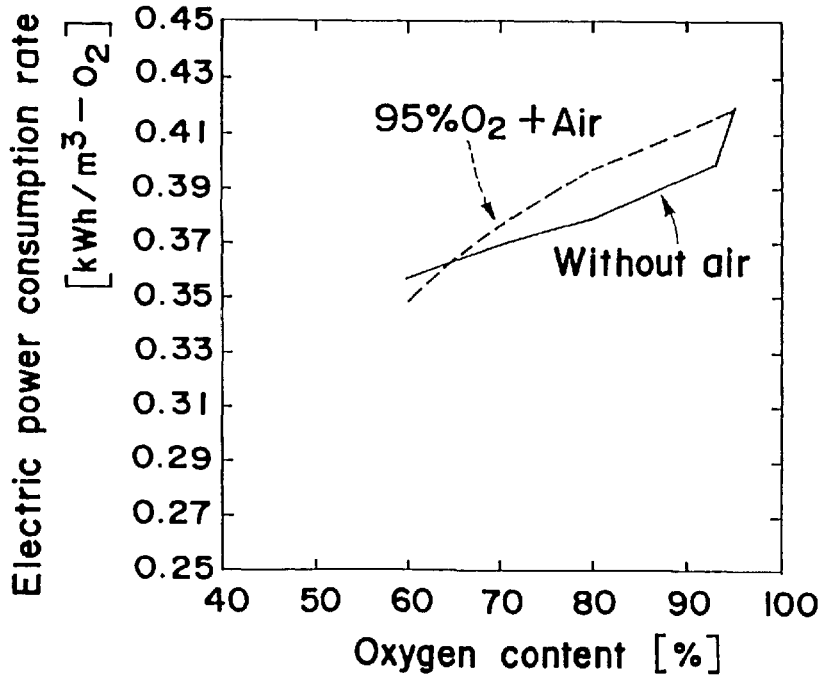
FIG. 9 is a graph comparing electric power consumption rates when combustion assisting gases of various contents prepared by producing an oxygen gas having an oxygen content of 95% using a PSA unit (pressure swing adsorption separator) and admixing air thereto in an oxygen-air mixer were used and those when oxygen gases of various contents were prepared (without admixing of air) employing the PSA unit were used.

Melting treatment of 1 ton of heavy scrap was carried out in the same manner as described above to measure the time required for melting it and the amount of molten metal formed and to calculate heat efficiency, yield, etc. The heat efficiency; yield and oxygen consumption relative to the oxygen content of the combustion assisting gas are shown in FIG. 6. Further, oxygen contents vs. electric power consumption rates for melting 1 ton of iron in the PSA unit and in the air liquefying and separating unit are shown in FIG. 7. FIG. 8 shows electric power consumption rates when combustion assisting gases of various contents prepared by producing an oxygen gas having an oxygen content of 98% using an air liquefying and separating unit and admixing air thereto in an oxygen-air mixer were used and those when oxygen gases of various contents were prepared (without admixing of air) employing the air liquefying and separating unit were used. FIG. 9 shows electric power consumption rates when combustion assisting gases of various contents prepared by producing an oxygen gas having an oxygen content of 95% using a PSA unit and admixing air thereto in an oxygen-air mixer were used and those when oxygen gases of various contents were prepared (without admixing of air) employing the PSA unit were used.

What is claimed is:

1. A method for melting a metallic material using a metal melting furnace having a melting section provided with an oxygen fuel burner, a preheating section for preheating a metallic material located above the melting section, and a reduced section located between the melting section and the preheating section; the reduced section having an inside diameter smaller than those of the melting section and the preheating section; the preheating section having a cross-sectional area of 1.5 to 4 times that of the reduced section; the preheating section having a substantial capacity of 0.5 to 2 times that of the melting section;

the method comprising burning a liquid fuel or a gaseous fuel in the oxygen fuel burner with the aid of a low-purity oxygen gas having an oxygen content of 65 to 94% supplied without heating from a pressure swing adsorption separator employing an adsorbent which adsorbs atmospheric nitrogen preferentially to atmospheric oxygen to melt the metallic material with flames injected from the oxygen fuel burner.

2. The method for melting a metallic material according to claim 1, wherein the oxygen content is 68 to 90%.

3. The method for melting a metallic material according to claim 1, wherein the oxygen content is 75 to 85%.

4. The method for melting a metallic material according to claim 1, wherein the liquid fuel is a heavy oil or kerosene.

5. The method for melting a metallic material according to claim 1, wherein the reduced section has a slant face of a ceiling of the melting section of 20 to 60° and a slant face of a bottom of the preheating section of 20 to 70°.

6. The method for melting a metallic material according to claim 1, wherein the gaseous fuel is propane gas or a natural gas.

* * * * *